United States Patent [19]

Sloan

[11] 4,029,438

[45] June 14, 1977

[54] WELL POINT PUMPING SYSTEM AND PUMP ASSEMBLY THEREFOR

[76] Inventor: Albert H. Sloan, 4201 Kean Road, Fort Lauderdale, Fla. 33314

[22] Filed: Oct. 20, 1975

[21] Appl. No.: 623,655

[52] U.S. Cl. ..... 417/200; 418/97

[51] Int. Cl.[2] ..... F04D 9/00; F01C 21/04

[58] Field of Search ..... 417/199 A, 200; 418/85, 418/3, 97; 137/202

[56] References Cited

UNITED STATES PATENTS

| | | | |
|---|---|---|---|
| 2,428,373 | 10/1947 | Lloyd | 417/200 |
| 2,535,583 | 12/1950 | Kroll | 417/200 |
| 2,784,674 | 3/1957 | Carver et al. | 137/202 |
| 3,306,314 | 2/1967 | Judsen | 137/202 |
| 3,860,364 | 1/1975 | Aronson | 417/204 |
| 3,867,070 | 2/1975 | Sloan | 417/200 |
| 3,904,319 | 9/1975 | Parish et al. | 417/200 |
| 3,910,728 | 10/1975 | Sloan | 417/390 |

*Primary Examiner*—William L. Freeh

*Attorney, Agent, or Firm*—James E. Nilles

[57] ABSTRACT

A well point pumping system which includes a series of well points installed in an area of the ground which is to be dewatered or dried out for example, before an excavation process. The well point system includes an engine driven impeller type pump usually located above the water line and which provides high lift, i.e., vacuum for the system. The pump is of a low specific speed and capable of a high vacuum (lift) and has a large impeller which operates at an efficient point in its characteristic curve and which functions to efficiently draw against a high content of air in the pumping system and in doing so operates at an efficient manner from a fuel consumption standpoint. The system also includes a vacuum pump which efficiently acts to aid in priming the system before the impeller pump takes over the task of the pumping operation. A peller valve operated float tank is used in conjunction with the vacuum pump to prime the system before the impeller pump comes into play for the main pumping operation.

13 Claims, 10 Drawing Figures

61
65
42
7
49
7
60
47
46
50
57
45
44
43a
45
46
40
53
43
75
37
39
74
73
70
36
96
IP
98
94
113
109
114
112
113
106
102
100
103
31
52
49

WELL POINT PUMPING SYSTEM AND PUMP ASSEMBLY THEREFOR

BACKGROUND OF THE INVENTION

The invention pertains to water pumping apparatus and systems for pumping water out of the ground. Prior art pumping apparatus are shown in my U.S. Pat. No. 3,867,070 entitled "Jet Water Pump Apparatus" which issued Feb. 18, 1975 and my U.S. Pat. No. 3,910,728 which issued Oct. 7, 1975 and entitled "Dewatering Pump Apparatus."

SUMMARY OF THE INVENTION

The present invention provides a well point pumping system and pumping apparatus which includes a series of well points installed in an area of the ground which is to be dewatered and before the excavation of the area actually takes place, the system also includes an impeller type pump having a large rotatable impeller having curved vanes that deliver the water to a stationary diffuser member that also has curved vanes that curve in an opposite direction of the impeller vanes.

In pumps of this type, the specific speed is represented by a known formula:

$$Ns = \frac{\text{r.p.m.} \times \sqrt{\text{g.p.m.}}}{H^{3/4}}$$

where r.p.m. is the speed of the impeller, g.p.m. is the water flowing through and H is the pressure head in gallons of water generated by the pump. The large impeller used with the present invention is driven through a gear reduction unit from the engine and results in a low specific speed, preferably about 1,000. By having a large impeller type pump with a low specific speed, excessive action on the water is minimized and cavitation due to formation of pockets of air between the blades is also minimized. The water entering the "eye" of the pump is at a rather slow speed and by the time this water reaches the radially outer end of the impeller, it has travelled a sufficient distance due to the size of the pump that velocity pressure is converted to static head with good efficiency and no cavitation. The resulting pump has high lift capabilities, operates at an efficient point in its characteristic curve and with low maintenance. The pump functions to efficiently move water with no appreciable cavitation and against a high content of air in the pumping system, at high suction lifts, and does so in an economical manner as far as fuel consumption is concerned. The system also includes a vacuum pump which acts to prime the entire system and rid the system of the majority of the air before the water load is imposed on the impeller pump. The invention also contemplates the use of a particular type of float operated valve in the priming or float chamber for the pump, and a particularly effective, two stage float chamber that insures no water enters the vacuum pump.

Another aspect of the present invention relates to an integral pump assembly and drive shaft assembly for efficiently mounting an impeller of the pump and also the drive shaft so that minimum bending or overhang moment is imposed on the drive shaft, a shorter drive shaft than conventional is possible, the number of bearings for the drive shaft is reduced, efficient sealing between the water and lubricant is provided, and wear on the impeller can be accommodated by the use of an adjustable wear ring.

These and other objects and advantages of the present invention will appear hereinafter as this disclosure progresses, reference being had to the accompanying drawings.

THE DRAWINGS

DESCRIPTION OF A PREFERRED EMBODIMENT

Figures 1, 2:
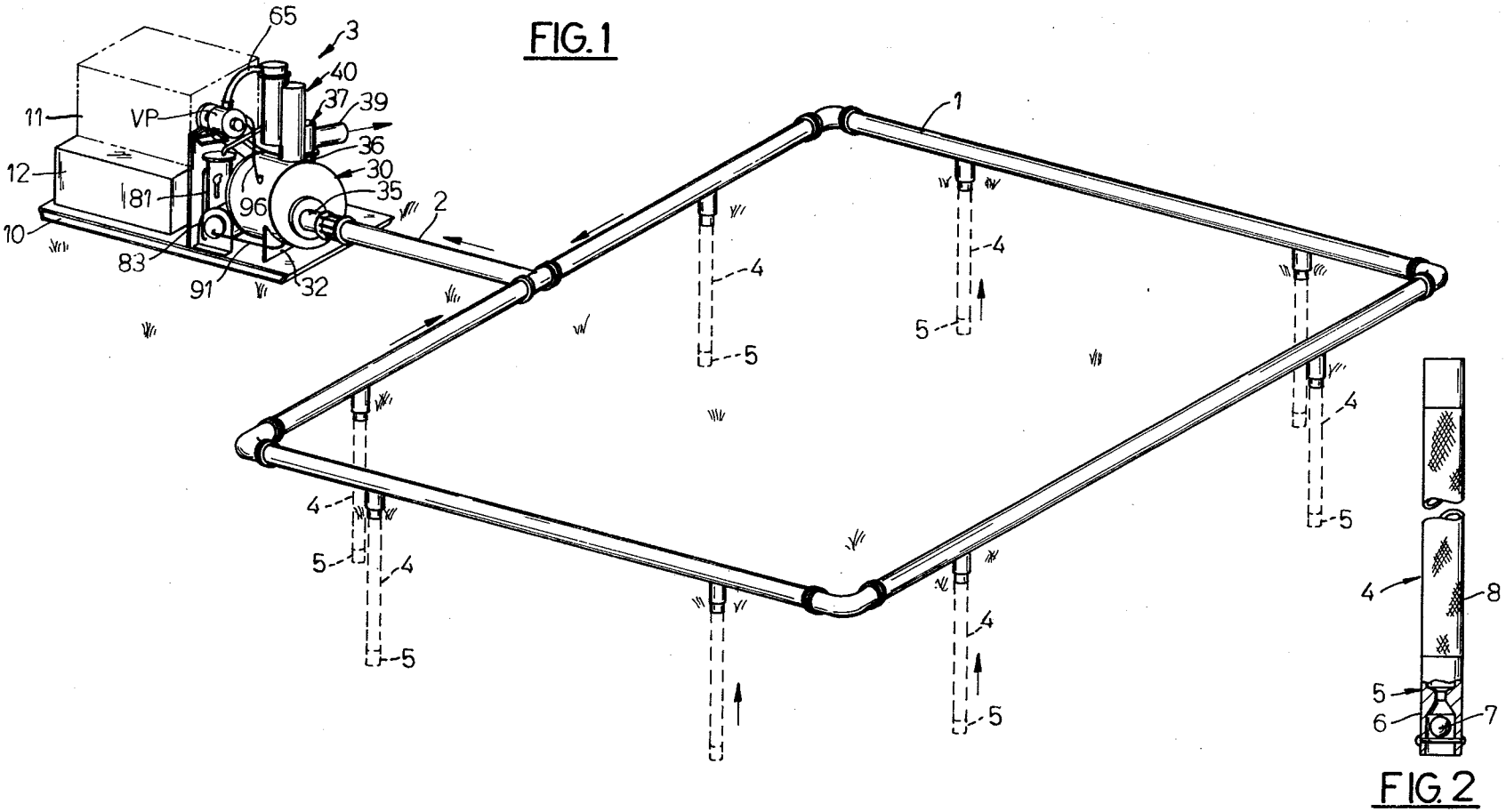
FIG. 1 is a perspective and schematic view of the pumping system made in accordance with the present invention.
FIG. 2 is an enlarged, fragmentary view partially in section of one of the well points shown in FIG. 1.

The general organization of the system is shown in FIG. 1 and includes a network of conduits 1 which are all connected together in any one of a number of patterns and lead, via conduit member 2, to the pump assembly 3. The conduit network has a series of downwardly extending conduit members 4 at the lower end of which are the well points 5 (FIG. 2). The well points are conventional in nature and include a lower end 6 having a one-way check ball valve 7 to thereby permit the well point to be forced into the ground by water that is forced under pressure through the check valve 7. Water is prevented from being drawn up from the soil by the ball valve 7. A stainless steel screen 8 permits water to enter the well point from the soil in the conventional manner.

The purpose of this general operation is to draw the water from the ground which is to be excavated to be able to more precisely form the excavated area and minimize cave-in of the ground. In other words, rather than dig an excavation for a building, for example, and then dewater the excavation so formed, the present invention contemplates drying out an area of ground prior to the excavating operation.

In an environment of the above type, the conduit arrangement is usually quite extensive and a high vacuum is required to draw the air out of the system, out of the well point assemblies, and also to accommodate general air leakage in the system.

The pump assembly 3 has been shown (FIG. 3) as mounted on a skid 10 which can be moved from one location to another. A power source such as an internal combustion engine 11 is mounted on the skid, more particularly, on the engine fuel tank 12. The drive shaft 13 of the engine is connected by timing pulleys 14, 15, and timing belt 16 to a power shaft 18 which is mounted in a bearing housing 19. Thus a speed reduction ratio, of about 1 to 1.57 is provided between the engine and the shaft 18 which drives a pump IP, to be described, at a relatively low, specific speed Ns of about 1,000.

Also secured to the main frame or skid 10 is a mounting plate 20 and which serves to support the bearing housing 19 and also serves to support a vacuum pump VP to be later referred to. Power is furnished to the vacuum pump via the pulley and sheave drive 22, the lower sheaves 22*a* of which are driven by the shaft 18 at a speed reduction.

Figure 8:
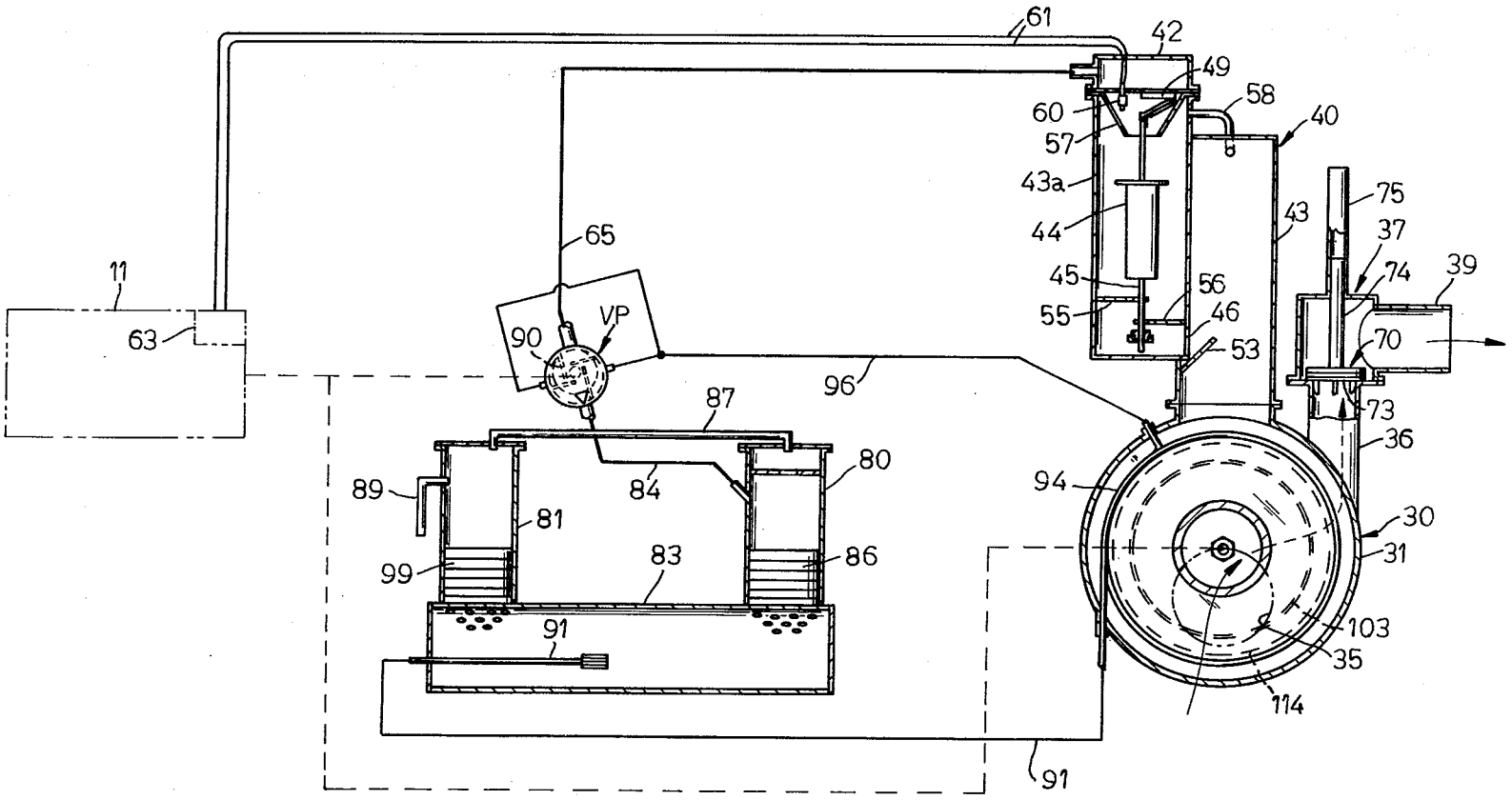
FIG. 8 is a transverse, vertical view generally schematic in nature and showing how the various parts of the FIG. 3 device are connected together, certain parts being shown as broken away or removed for the sake of clarity.

An impeller pump housing 30 is mounted at the end of the skids remote from the engine and includes a generally cylindrical side wall 31, a generally vertical back wall 34, and a front wall 31*a*. The housing 30 is supported by brackets 32 on the skid frame 10. The housing 31 supports an impeller pump I*p* within it, more particularly, the bearing housing 19 is supported by a flange 33 to the back wall 34 of the pump housing. A water inlet connection 35 extends from the front wall 31 of the housing 30 and is connected to the conduit network 1. The water drawn in by the impeller pump IP through the inlet 35 is discharged out of the tangentially extending discharge conduit 36 (FIG. 8) through the discharge valve assembly 37 and out the discharge conduit 39. Also extending upwardly from the top of the pump housing 30 is the two part or two compartment float housing 40. A vacuum chamber 42 is located above the float housing 40.

The action of the impeller pump generally speaking is to draw the water in from the conduit network and discharge it out of the outlet conduit 39. One part of the float housing 40 is comprised of a generally cylindrical member 43 which is in fluid communication with the other member 43*a*. The interior of the housing 40 is in fluid communication with the interior of the pump housing 30, as clearly shown in FIG. 6.

The float housing is made of two compartments 43 and 43*a* because the water that rushes into the float housing from the pump chamber is turbulent and is churning with air. By the time this water reaches the second compartment 43*a*, it is more quiescent and will therefor not get past the peller valve, to be presently described.

Figures 6, 7:
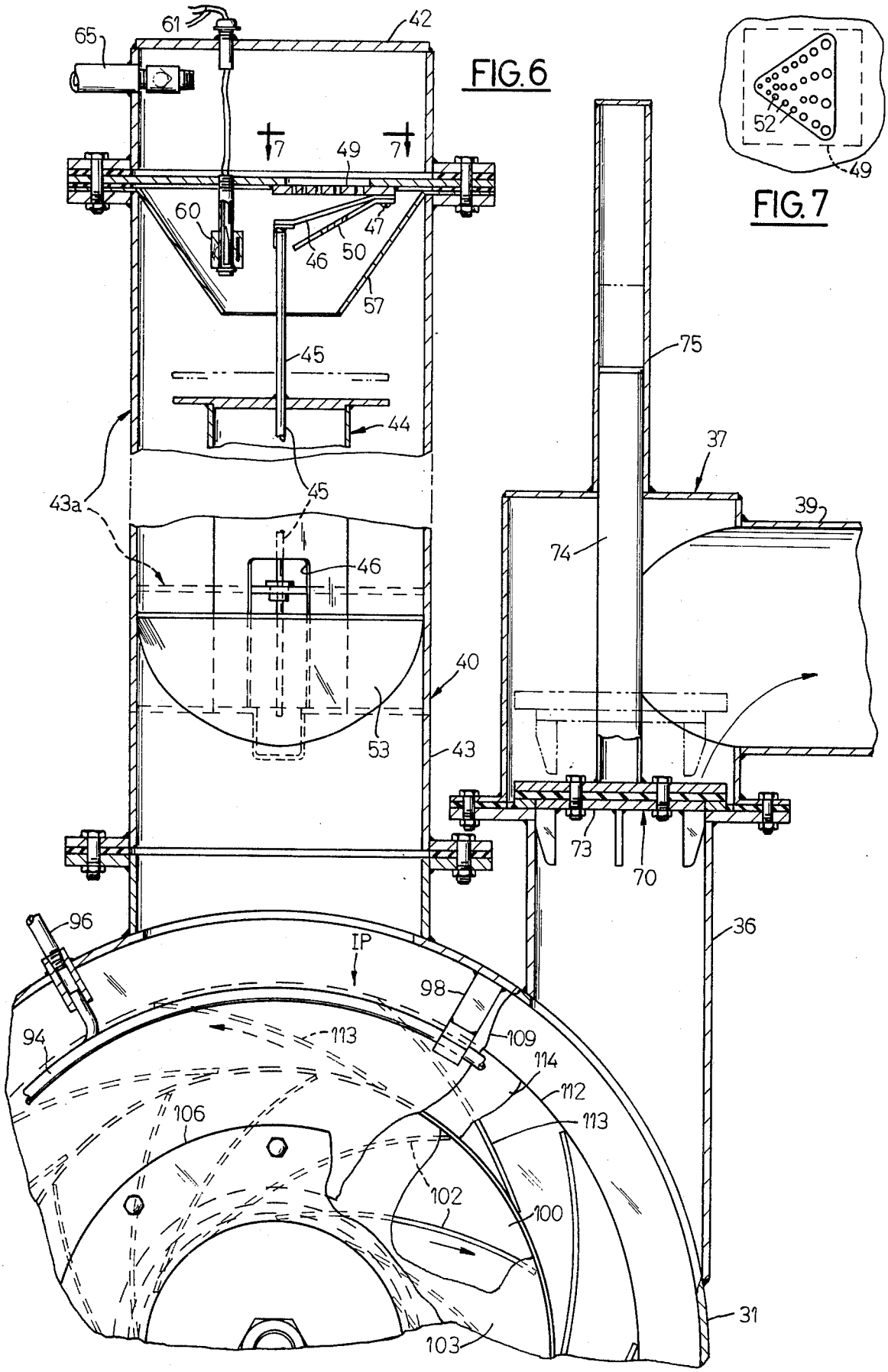
FIG. 6 is a sectional view taken generally along the line 6—6 in FIG. 3, the upper portion of the view, however, being rotated 90° from the rest of the view for clarity in showing the peller valve; the figure is also on an enlarged scale and with certain parts shown as being broken away or removed for the sake of clarity in the drawings.
FIG. 7 is a sectional plan view taken generally along the line 7—7 in FIG. 6 and showing the peller valve suction plate.

The float housing member 43*a* includes a vertically shiftable float assembly 44 mounted centrally therein and to the upper end of a float rod 45 of the assembly is secured a flexible valve member 46, for example, fabricated from rubber. One side of the rubber plate valve 46 is secured by bolt means 47 to a valve plate 49, and the other end of the rubber valve 46 is secured to the upper end of the float rod 45. A stop member 50 is also secured to the valve plate so as to limit the downward movement of the rubber valve plate 46. The valve plate 49 comprises a series of holes 52 which are arranged in a triangular pattern as shown in FIG. 7. These holes place float chamber 40 in air communication with the vacuum chamber 42. This peller type valve formed by rubber element 46 and valve plate 49 is such that its opening and closing is gradual. In other words, the first portion of the valve to be opened is located at the small end of the triangular pattern; namely where the small holes 52 are located. Then, as the rubber valve plate 46 moves downwardly to open the valve, a greater number of holes, preferably graduated increasingly in size, are gradually uncovered. In this manner, the valve is gradually and smoothly opened and closed in a progressive manner and this type of valve has been found desirable in an operation such as with the present invention, because extreme difficulty has been found in actuating valves of other types.

Baffle means are provided within the housings 43 and 43*a* so as to eliminate the surging and churning action of the water as it enters the housing. More specifically, a baffle 53 is located in housing 43 adjacent the opening 44 between the housings. Additional and vertically spaced baffles 55 and 56 are located within the housing 43*a*. A frusto-conical shaped baffle 57 is then located at the upper end of housing 43*a* and around the peller valve. Furthermore, an air tube 58 connects the upper portion of housing 43 to the upper portion of housing 43*a* and serves to permit air which has become entrapped in the upper end of housing 43 to pass into the housing 43*a*. By this means, the mixture of air and water as it comes surging into the housing 43*a* is quieted or slowed down by the time it reaches the upper portion of housing 43*a*. This insures that only air passes through the peller valve.

Under certain conditions it may be desirable to provide a conventional, Gem type, normally open electric float switch 60 adjacent the upper end of the float housing. A pair of electrical wires 61 extend from this switch 60 to an electrical solenoid fuel valve 63 of the engine, and the arrangement is such that if the water raises in the float chamber sufficiently to actuate the switch 60, fuel solenoid 63 is actuated to shut-off the fuel supply to the engine. In this manner, when the water raises above a predetermined point in the float chamber, the engine is shut-off and thereby water is prevented from flowing via the air conduit 65 into the vacuum pump VP.

Referring again to the discharge housing 37, a vertically shiftable valve 70 is shown in full lines in FIG. 6 where no air can enter the impeller pump housing. The broken line position of the valve assembly shows the valve when raised to a water discharging position. The valve assembly 70 includes a plate valve element 73 and has a plunger rod 74 extending forwardly therefrom. The plunger rod is guided in an upwardly extending cylindrical tube 75. Thus, the valve assembly 70 functions to prevent air from being sucked into the system when the impeller pump is not actually pumping water out of the discharge conduit 39.

The system also includes the vacuum pump VP which as indicated, sucks air out of the system via the float housing 40 and vacuum chamber 42. This air is then discharged into an exhaust system which comprises two vertically arranged tanks 80, 81 (FIG. 8) which are in communication with a horizontally disposed tank 83. The air is conducted first to tank 80 and then through a pipe 87 and to the other tank 81 where it can be discharged to atmosphere via the outlet pipe 89. The present invention also contemplates that the vacuum pump VP is flooded with oil to promote sealing of its sliding vanes 90 and also to cool the pump. The vacuum pump of the present invention can pump a very large quantity of air with approximately two gallons of oil. This oil is taken from the reservoir 83 via line 91 and then to a heat exchanger 94 in the form of a coil tube which may be as much as 50 feet in length and formed of 2⅝ inch copper tubing. The heat exchanger 94 is held in place by brackets 98 (FIG. 6). After the oil is cooled by the incoming water, it then enters the vacuum pump via line 96. After being mixed with air in the pump VP, the mixture of air and oil is discharged via line 84 from the pump and into the vertical tank 80 as previously mentioned. The oil may be passed through a series of filters 86, such as six to eight inch latex covered fiber discs 95, and is collected in the horizontal tank 83. When the air is transferred to tank 81 via line 87, any oil remaining in it is then passed through the filters 99 and into the collecting tank 83. Within the collecting tank 83 is an outlet pipe 91 which as mentioned leads to the heat exchanger.

The lubricating of the vacuum pump is of a flooding nature rather than simply that of dripping oil on the vanes as in prior art devices, and permits the vacuum pump to run at much higher vacuums.

Figure 3:
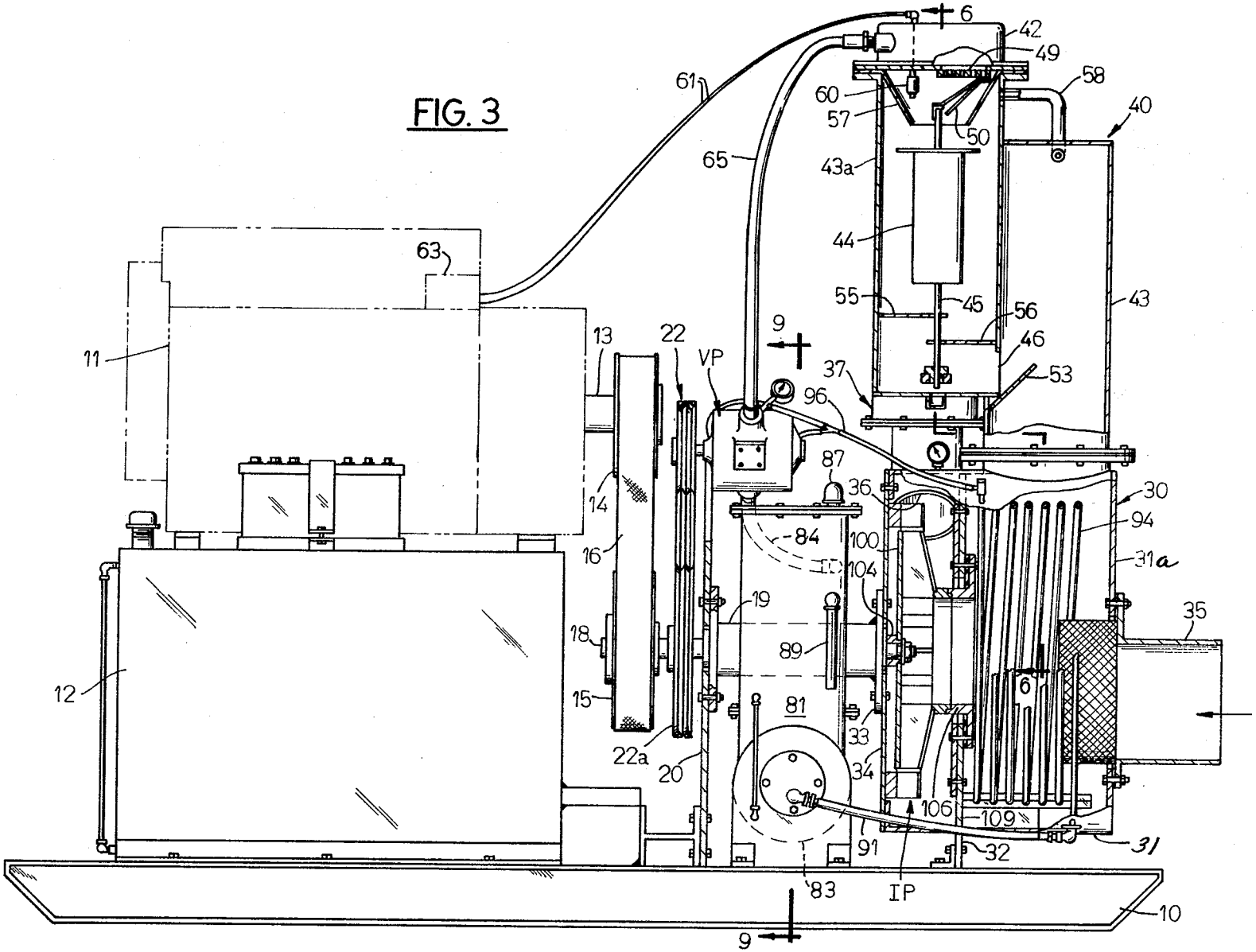
FIG. 3 is a side elevational view of the pumping apparatus shown in FIG. 1, but on an enlarged scale, certain parts being shown in section or broken away for the sake of clarity in the drawings.
Figures 4, 5:
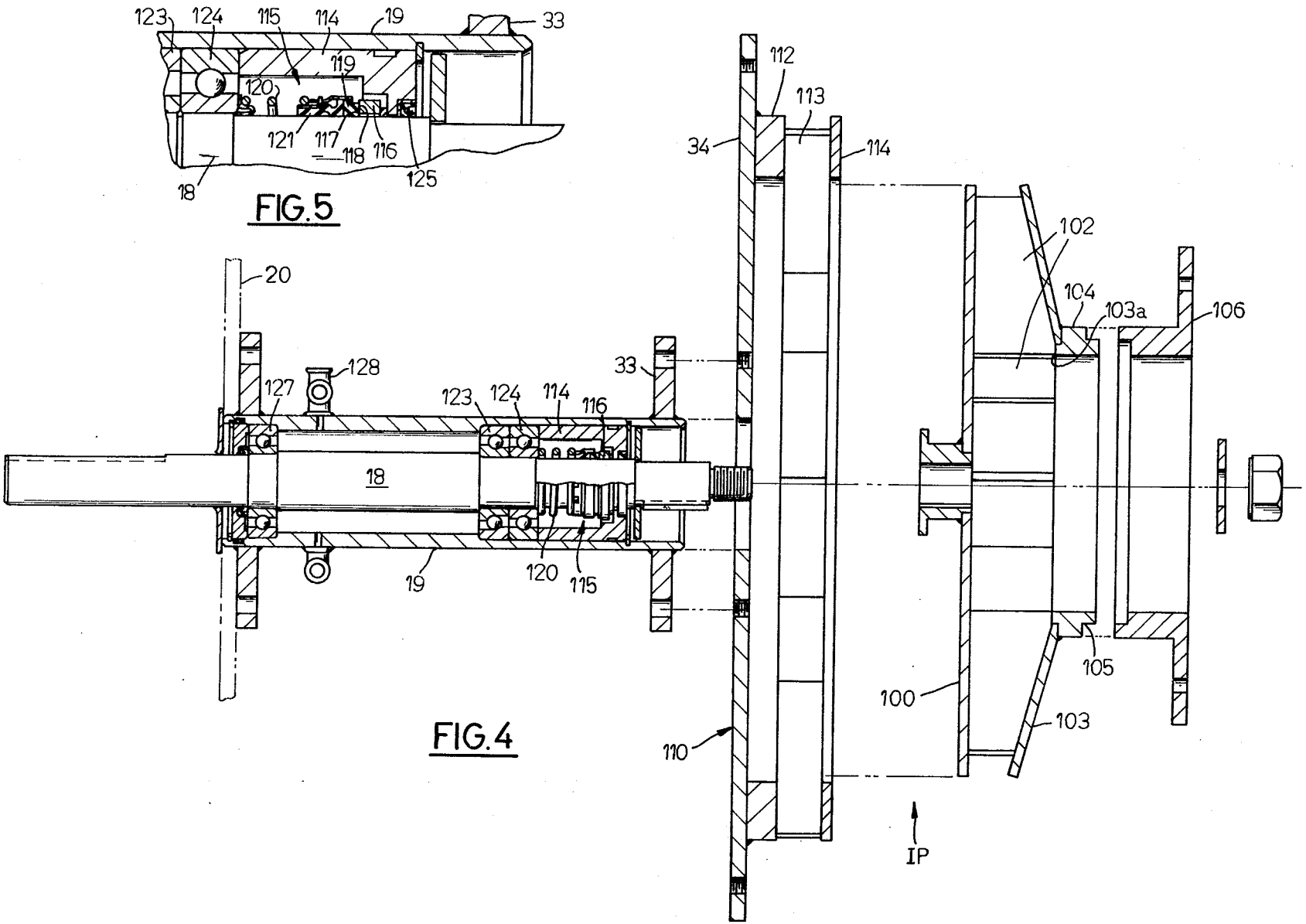
FIG. 4 is an exploded section view of the assembly of the pump drive shaft, and the impeller, diffuser, and wear ring shown in FIG. 3.
FIG. 5 is an enlarged fragmentary view of a portion of FIG. 4.

Referring now in detail to the impeller type pump, and particularly to FIGS. 3, 4, and 6, the impeller of the pump comprises a flat, rear vertical circular plate 100, the front plate 103 of generally dish-shape, and having a central opening 103*a* which generally forms the "eye" of the pump. The two plates are rigidly secured together and spaced apart by the series of curved vanes 102 which curve in a direction shown in FIG. 6. Thus, a series of circular or spirally shaped channels are formed in the impeller and through which the water passes as the impeller rotates; that is, the water enters the eye of the impeller and then passes radially outwardly and its speed is increased by the rotating impeller. A front mounting hub 104 is secured to the impeller plate 103 and has an annular groove 105 which forms a seat for rotatably supporting the front end of the impeller in a wear plate 106. The wear plate is adjustably secured to the center wall 109 of the pump housing.

The pump also includes a diffuser member 110 comprised of rear mounting plate 34 and a ring 112 welded thereto. A series of curved vanes 113 are secured to the ring 112 and also secured to a front ring 114. The curvature of the vanes 113 is in the direction opposite to the curvature of the vanes of the impeller. Thus, the impeller discharges water radially to the vanes 113 of the stationary diffuser member and the water is then exited radially from the diffuser member. The above impeller/diffuser type pump is of low specific speed, approximately 1,000, but operates at high velocity and good efficiency. The pump acts to covert the velocity of incoming water to static head. There is little horsepower lost because entrapment of air for cavitation between the blades is prevented, primarily due to the slow specific speed and the relatively large diameter size of the pump. The pump is driven at a speed considerably less than that of the source of power and excessive chopping or churning action of the water is prevented and consequently, cavitation is held to a minimum. The water entering the eye of the pump is at a rather slow speed but increases as it moves radially along the pump vanes converting the velocity head to static head with good efficiency and no cavitation.

An integral unit is formed by the pump housing and the drive shaft assembly. The drive shaft assembly for the impeller of the pump is so constructed so that a minimum number of bearings is necessary and there is no overhang of the shaft which would otherwise contribute to wear of the bearings and other parts and generally short life of the assembly. As shown in FIGS. 4 & 5, a rotary seal 115 is used between the pump housing wall 34 and the bearing shaft 18 and it keeps water out of the shaft bearing housing 19. This mechanical, rotary sliding seal 115 is mounted in a tubular seal holder 114 and includes a ring 116 having a ground flat radial surface 117 against which a ground flat surface 118 of a ring 119 is spring loaded by spring 120. Ring 119 is formed preferably of tungsten carbide and is cemented to a flexible boot 121, a pair of anti-friction ball bearing assemblies 123 and 124, journal shaft 18 in the housing 19, a flexible seal 125 is press fit in the counterbored end of the seal holder 114 and serves primarily to keep out dirt.

The bearing shaft assembly also includes another anti-friction bearing assembly 127 at the other end of shaft 18. The interior of shaft housing 19 is filled with oil via inlet 128 and is thus pressurized with oil to lubricate the various bearings and also prevent water from entering the impeller end of the bearing shaft assembly. Furthermore, with the above-described bearing arrangement, the bending moment on the drive shaft is minimized and provides good support for the impeller located on the end of the drive shaft. A short drive shaft is thus made possible, the number of bearings is held to a minimum, and efficient sealing between the incoming water of the pump and the bearing assembly is provided.

OPERATION

The general organization of the system is as follows. To commence a pumping operation, the engine is turned on and the vacuum pump commences sucking the air out of the conduit network including the well points themselves. As the vacuum pump is draining the system of the air, the water from the ground enters the system, fills the conduit network, and enters the impeller pump. The water continues to be sucked by the vacuum pump into the float chamber, causing the float to rise to a certain height, and the float then normally remains at a certain level during operation.

The peller valve remains partially open and the system normally runs with this valve in this partially open position, which functions to take care of the air leaking into the various conduits, and elsewhere in the system. When there is no air in the system, which is an unusual circumstance, the peller valve would be closed. However, in the majority of situations during operation, the peller valve is partially open and this valve thus accommodates a steady volume of air which passes through the system and functions to keep the impeller pump primed at all times. Thus, the float chamber is filled and can then act to prime the system.

The primed impeller pump then picks up the load and pumps the water from the conduit network and well points thereby commencing to drain the ground being dewatered. At the same time, the vacuum pump continues working to suck the air out of the system and it also aids in pulling the water into the impeller pump which itself also acts to create a vacuum to draw in the water. The pump is of the impeller/diffuser type, as opposed for example to a volute type, and this pump has a ring of generally curved and radial passages stationarily mounted around its impeller. The water enters the impeller rather slowly from the pump inlet but is then pushed rapidly by the impeller and through the diffuser, thereby the velocity of the water is converted to static head.

While the vacuum pump is running, oil is used to lubricate it and a steady flow of oil acts to maintain the vacuum pump vanes sealed and thereby provide better suction. The vacuum pump of the present invention is actually flooded with oil as opposed to prior art devices which simply cause oil to be dripped rather slowly into the pump. The oil from this flooded vacuum pump system is passed through an oil and air separator and then is cooled by a heat exchanger located in the flow path of the incoming water.

Figure 10:
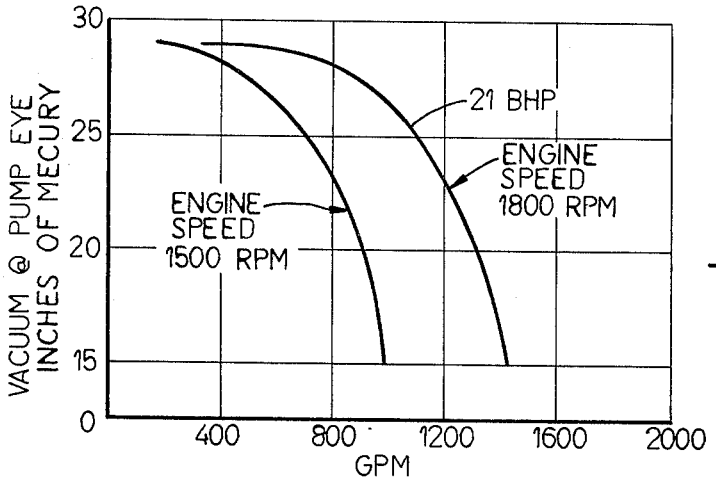
FIG. 10 is a graph of the operating characteristics of a system made in accordance with the present invention and is a plot of inches of mercury of vacuum plotted against gallons per minute discharge of the pump and at two different engine speeds.
Figure 9:
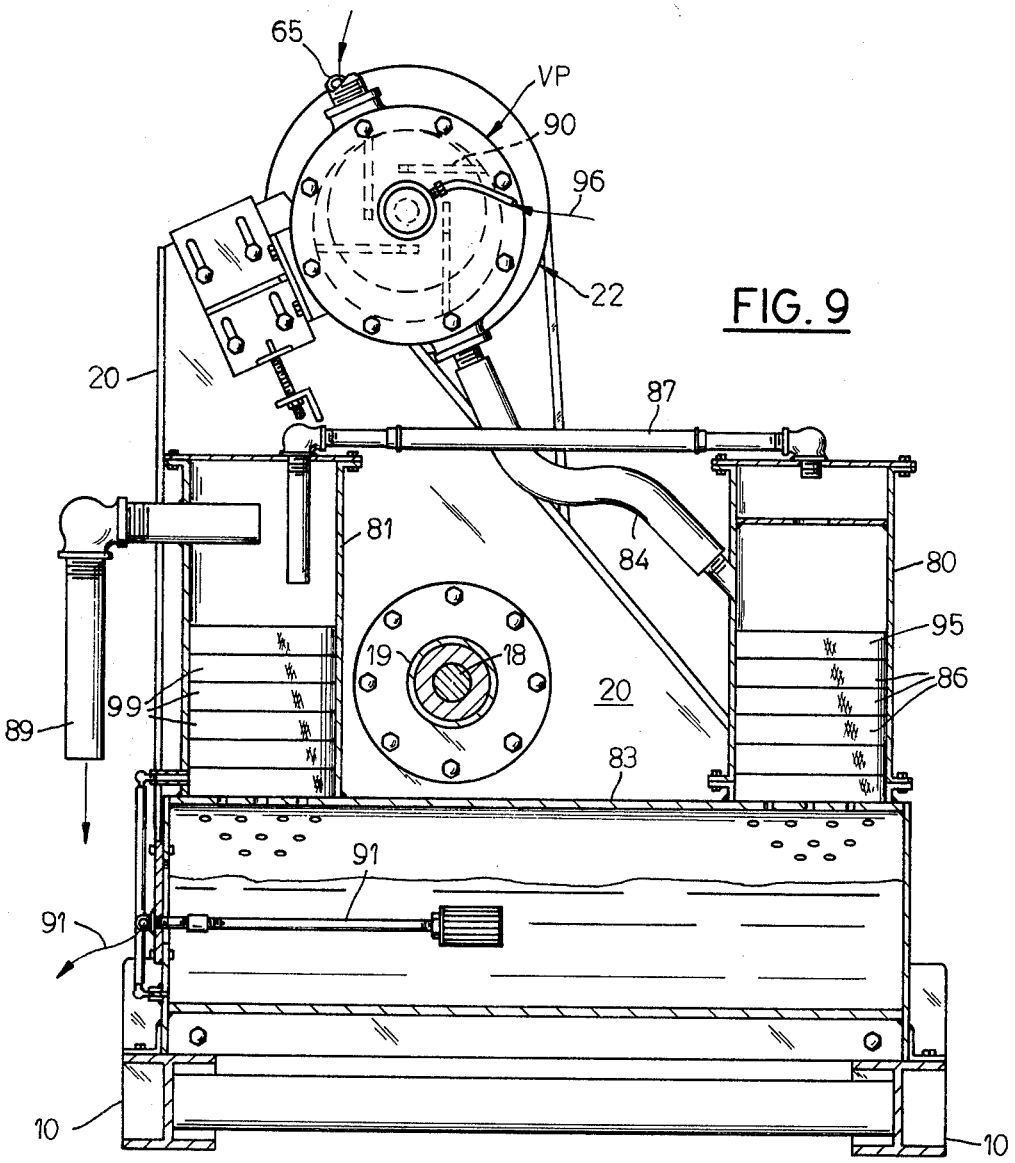
FIG. 9 is a transverse, vertical view taken generally along the line 9—9 in FIG. 3.

The characteristics of the well point pump of the type involved in the present invention are best illustrated by measuring the discharge of the pump in comparison to the inches of vacuum of the pump, for example, as measured at the eye of the pump. The graph of FIG. 10 illustrates the characteristics of the present invention and shows how the well point pump of the present invention is very efficient in inducing water into the pump at various inches of vacuum of mercury as measured at the eye of the pump. In other words, this ability of the pump is commonly referred to as its ability to "suck" water into the pump which is actually measured as net water pressure or how much the pump will induce water into itself. The graph shows such volume of water plotted against the inches of vacuum as measured at the eye of the pump and for two different engine speeds.

In general in regard to the system, the present pump assembly has high lift and high vacuum capabilities, and provides large air handling capacity with low maintenance and at high efficiency.

I claim:

1. A well point pumping system comprising conduit means extending over an area of ground to be drained of water and having well point means extending into the ground for extracting water therefrom, a pump assembly connected to said conduit means for pumping water from said conduit means, said assembly including a pump housing, an impeller type pump mounted in said housing and for causing water to flow through said conduit means and into said housing, said impeller pump including a rotatable pumping impeller member having curved vanes, and a stationary diffuser member surrounding said impeller and for receiving water discharged therefrom, said diffuser including curved vanes which curve in a direction opposite to said vanes of said impeller to thereby convert velocity of said water into static head; a float housing in fluid communication with and mounted on said pump housing and for receiving water therefrom, float means in said float housing and vertically shiftable in accordance with the water level in said housing, a vacuum chamber in communication with the float chamber of said float housing, a peller type valve connected between said float and said vacuum chambers for permitting air to pass from said float chamber into said vacuum chamber, but for preventing water from entering said vacuum chamber from said float chamber, a discharge housing including a discharge valve in communication with said pump chamber and for permitting water to be pumped out of said pump chamber but preventing air from entering said pump chamber via said discharge chamber, power source means connected to said impeller pump for driving the latter in water pumping operation, a vacuum pump in air receiving communication with said vacuum chamber, oil and air separator means for receiving a mixture of oil and air from said vacuum pump, and oil circulating conduit means for flooding said vacuum pump with oil to thereby lubricate, seal, and cool said vacuum pump, a heat exchanger means in said pump housing and communicating with said vacuum pump for circulating oil thereto.

2. The system set forth in claim 1 including a float type electric switch in said float chamber and having an electrical connection with said power source means for shutting off the latter when the water level in said float housing reaches a pre-determined level.

3. The system as set forth in claim 1 further characterized in that said peller type valve includes a valve plate having a series of holes therethrough, and a flexible plate shiftably mounted with respect to said valve plate to progressively open and close said series of holes.

4. A well point pumping system comprising conduit means extending over an area of ground to be drained of water and having well point means extending into the ground for extracting water therefrom, a pump assembly connected to said conduit means for pumping water from said conduit means, said assembly including a pump housing, an impeller type pump mounted in said housing and for causing water to flow through said conduit means and into said housing, said impeller pump including a rotatable pumping impeller member having curved vanes, and a stationary diffuser member surrounding said impeller and for receiving water discharged therefrom, said diffuser including curved vanes which curve in a direction opposite to said vanes of said impeller to thereby convert velocity of said water into static head; a float housing in fluid communication with and mounted on said pump housing and for receiving water therefrom, float means in said float housing and vertically shiftable in accordance with the water level in said housing, a vacuum chamber in communication with the float chamber of said float housing, a peller type valve connected between said float and said vacuum chambers for permitting air to pass from said float chamber into said vacuum chamber, but for preventing water from entering said vacuum chamber from said float chamber, a one-way discharge valve in communication with said pump chamber and for permitting water to be pumped out of said pump chamber, power source means for driving said impeller pump in water pumping operation, a vacuum pump in air receiving communication with said vacuum chamber, and oil circulating means for flooding said vacuum pump with oil to thereby lubricate, cool and seal said vacuum pump.

5. The system set forth in claim 4 including a float type electric switch in said float chamber and having an electrical connection with said power source means for shutting off the latter when the water level in said float housing reaches a predetermined level.

6. The system as set forth in claim 4 further characterized in that said peller type valve includes a valve plate having a series of holes therethrough, and a flexible plate shiftably mounted with respect to said valve plate to progressively open said close and series of holes.

7. A water pump assembly for pumping water from the ground, said assembly including a pump housing, an impeller type pump mounted in said housing and for causing water to flow into said housing, said impeller type pump including a rotatable pumping impeller having curved vanes, and a stationary diffuser surrounding said impeller and for receiving fluid discharge water discharged therefrom, said diffuser including curved vanes which curve in a direction opposite to said vanes of said impeller to thereby convert velocity of said water into static pressure, a float housing in fluid communication with and mounted on said pump housing and for receiving water therefrom, float means in said float housing and vertically shiftable in accordance with the water level in said housing, a vacuum chamber in communication with the float chamber of said float housing, a peller type valve connected between said float and said vacuum chambers for permitting air to pass from said float chamber into said vacuum chamber, but for preventing water from entering said vacuum chamber from said float chamber, a discharge housing including a discharge valve in communication with said pump chamber and for permitting water to be pumped out of said pump chamber but preventing air from entering said pump chamber via said discharge chamber, power source means connected to said impeller pump for driving the latter in water pumping operation, a vacuum pump in air receiving communication with said vacuum chamber, oil and air separator means for receiving a mixture of oil and air from said vacuum pump and oil circulating conduit means for flooding said vacuum pump with oil to thereby lubricate and seal said vacuum pump, a heat exchanger means in said pump housing and communicating with said vacuum pump for circulating oil thereto.

8. The system set forth in claim 7 including a float type electric switch in said float chamber and having an electrical connection with said power source means for shutting off the latter when the water level in said float housing reaches a predetermined level.

9. The system as set forth in claim 7 further characterized in that said peller type valve includes a valve plate having a series of holes therethrough, and a flexible plate shiftably mounted with respect to said valve plate to progressively open and close said series of holes.

10. A water pump assembly for pumping water from the ground, said assembly including a pump housing, an impeller type pump mounted in said housing and for causing water to flow into said housing, said impeller type pump including a rotatable pumping impeller having curved vanes, and a stationary diffuser surrounding said impeller and for receiving fluid discharge water discharged therefrom, said diffuser including curved vanes which curve in a direction opposite to said vanes of said impeller to thereby convert velocity of said water into static head, a float housing in fluid communication with said pump housing and for receiving water therefrom, float means in said float housing and vertically shiftable in accordance with the water level in said housing, a vacuum chamber in communication with the float chamber of said float housing, a peller type valve connected between said float and said vacuum chambers for permitting air to pass from said float chamber into said vacuum chamber, but for preventing water from entering said vacuum chamber from said float chamber, a one-way discharge valve in communication with said pump chamber and for permitting water to be pumped out of said pump chamber, power source means for driving said impeller pump, a vacuum pump in air receiving communication with said vacuum chamber, and oil circulating means for flooding said vacuum pump with oil to thereby lubricate, cool and seal said vacuum pump.

11. The system set forth in claim 10 including a float type electric switch in said float chamber and having an electrical connection with said power source means for shutting off the latter when the water level in said float housing reaches a predetermined level.

12. The system as set forth in claim 10 further characterized in that said peller type valve includes a valve plate having a series of holes therethrough, and a flexible plate shiftably mounted with respect to said valve plate to progressively open and close said series of holes.

13. The system as set forth in claim 11 further characterized in that said peller type valve includes a valve plate having a series of holes therethrough, and a flexible plate shiftably mounted with respect to said valve plate to progressively open and close said series of holes.

* * * * *